US006193473B1

(12) United States Patent
Mruk et al.

(10) Patent No.: US 6,193,473 B1
(45) Date of Patent: Feb. 27, 2001

(54) DIRECT DRIVE COMPRESSOR ASSEMBLY WITH SWITCHED RELUCTANCE MOTOR DRIVE

(75) Inventors: Gerald K. Mruk, West Seneca; Peter J. Weber, Williamsville; Forrest G. Landes, Kenmore, all of NY (US)

(73) Assignee: Cooper Turbocompressor, Inc., Houston ( * ) Notice: Subject to any disclaimer, the term of this patent is extended or adjusted under 35 U.S.C. 154(b) by 0 days.

(21) Appl. No.: 09/282,762

(22) Filed: Mar. 31, 1999

(51) Int. Cl.[7] ..... F04B 17/00; H02K 1/00

(52) U.S. Cl. ..... 417/350; 417/423.5; 417/355; 417/423.7; 310/179

(58) Field of Search ..... 417/350, 244, 417/423.5, 423.7, 355, 353, 545, 555.1, 259, 364; 60/595; 310/179, 15

(56) References Cited

U.S. PATENT DOCUMENTS

| | | | | |
|---|---|---|---|---|
| 3,947,155 | * | 3/1976 | Bidol | 417/417 |
| 4,179,630 | * | 12/1979 | Stuber | 310/15 |
| 4,428,715 | | 1/1984 | Wiggins . | |
| 4,758,132 | * | 7/1988 | Hartwig | 417/353 |
| 4,977,344 | * | 12/1990 | Obradovic | 310/217 |
| 5,128,576 | * | 7/1992 | Obradovic | 310/217 |
| 5,522,653 | | 6/1996 | Fulks et al. . | |
| 5,654,601 | | 8/1997 | Fulton . | |
| 5,770,910 | | 6/1998 | Horst . | |
| 6,015,270 | * | 1/2000 | Roth | 417/259 |
| 6,043,580 | * | 3/2000 | Voget et al. | 310/179 |
| 6,056,518 | * | 5/2000 | Allen et al. | 417/355 |

* cited by examiner

*Primary Examiner*—Teresa Walberg
*Assistant Examiner*—Jeffrey Pwu
(74) *Attorney, Agent, or Firm*—Kurt D. Van Tassel; Deborah G. VandenHoff; Van Tassel & Associates

(57) ABSTRACT

A centrifugal compressor assembly, especially one having two or more stages, has a first compressor casing having a fluid inlet and a fluid outlet and a first impeller rotatable within the first compressor casing. A second compressor casing provided having a fluid inlet and a fluid outlet and a second impeller rotatable within the second compressor casing. Drive for the compressors is provided by a switched reluctance motor disposed between the first and second compressor casings and comprising a stator and a rotor rotatable within the stator. A drive shaft is provided, wherein the first impeller, second impeller and the rotor are mounted on the drive shaft and rotatable therewith.

9 Claims, 1 Drawing Sheet

DIRECT DRIVE COMPRESSOR ASSEMBLY WITH SWITCHED RELUCTANCE MOTOR DRIVE

TECHNICAL FIELD OF THE INVENTION

The present invention relates to a compressor assembly, in particular to a compressor assembly comprising a compressor having a rotatable impeller and a motor driving the compressor, the impeller and the motor being linked by a direct drive.

BACKGROUND OF THE INVENTION

Compressors having an impeller rotatable within a compressor casing are well known in the art. Such compressors include both centrifugal compressors or radial flow compressors and axial flow compressors. In centrifugal or radial flow compressors, the fluid being compressed is caused by the rotating impeller to flow along a passageway in which the cross sectional area normal to the flow gradually decreases in the direction of flow. Axial compressors operate by causing the fluid to be compressed to flow along a passage of constant or substantially constant cross sectional area. An example of such a compressor is disclosed in U.S. Pat. No. 4,428,715.

Compressors of the aforementioned types may be driven by a range of motors, such as internal combustion engines, and turbines. However, in many applications it is both preferable and desirable to drive centrifugal and axial flow compressors using electric motors. Typically, induction or synchronous electric motors have been employed to drive compressors. To date, a major drawback associated with the use of electric motors to drive rotating impeller compressors has been the linkage between the electric motor and the compressor impeller. A given compressor will have a specific speed of rotation of the impeller in order to achieve the compression duty required of it. At the same time, an induction electric motor will have an optimum speed of rotation, at which the torque output is at a maximum. Heretofore, in order to link the compressor with a suitable electric drive motor, it has been necessary to employ an arrangement of one or more gears. In this way the different optimum speeds of rotation of the compressor and the electric motor can be accommodated. A particular problem arises in the case of high speed centrifugal compressors, having power requirements of the order of 200 horsepower or less. Such compressors are often required to operate at speeds in excess of 50,000 rpm. The optimum speed of rotation of an induction electric motor suitable for this duty is far lower than the speed of rotation required of the high speed compressor, requiring a gear assembly to be employed in the drive assembly of the compressor. However, for such compressors, the high costs of incorporating an arrangement of gears in the drive assembly results in a significant economical disadvantage. This in turn has led to other forms of compressors, such as screw compressors, being favored for such duties.

Accordingly, there is a need for a compressor assembly in which the requirement for a gear assembly in the drive is dispensed with and in which the compressor and the electric motor are directly linked.

SUMMARY OF THE INVENTION

According to the present invention there is provided a compressor assembly comprising:

a compressor having a compressor casing comprising a fluid inlet and a fluid outlet;

an impeller rotatable within the compressor casing;

a switched reluctance motor;

a rotatable drive shaft assembly extending from the switched reluctance motor into the compressor casing;

the impeller being mounted on the drive shaft assembly and rotatable therewith within the compressor casing; and the switched reluctance motor comprising a stator and a rotor, the rotor being mounted on the drive shaft assembly and rotatable therewith.

It has surprisingly been discovered that a switched reluctance motor may be employed to drive a rotating impeller compressor using a direct drive configuration, that is one in which the impeller of the compressor and the rotor of the motor are directly connected and rotate at the same speed. It has been found that the use of a switched reluctance motor to drive the rotatable impeller of a compressor allows the gear assembly or gear box to be dispensed with and a direct drive assembly to be employed.

The compressor may be either an axial flow compressor or a centrifugal or radial flow compressor. The preferred embodiment of the present invention employs a centrifugal or radial flow compressor.

The compressor assembly of the present invention is particularly suitable for operation at high speeds of rotation. Accordingly, the compressor preferably rotates at a speed greater than 25,000 rpm, more preferably at a speed greater than 50,000 rpm.

Although any size or rating of compressor may be used, the compressor assembly of the present invention offers particular advantages when the compressor has a power input requirement of less than 200 horse power.

The compressor assembly preferably comprises first and second compressors having first and second compressor casings, each of the first and second compressor casings comprising a fluid inlet and a fluid outlet. First and second impellers are located within and rotatable within the first and second compressor casings respectively. The first and second impellers are mounted on the drive shaft assembly and rotatable therewith. Such a compressor assembly may comprise two separate compressors driven from the same switched reluctance motor. More preferably, however, the two compressors are combined to form a two-stage compressor assembly. In such an arrangement, the fluid outlet of the first compressor casing communicates with the fluid inlet of the second compressor casing. In a two compressor assembly or two-stage compressor assembly, the switched reluctance motor is most conveniently disposed between the first and second compressor casings, with the rotor of the switched reluctance motor being mounted on the drive shaft assembly between the first and second impellers.

References in this specification to a "drive shaft assembly" are to a linkage transferring drive from the switched reluctance motor to the impellers of the compressor assembly. The drive shaft assembly provides a direct drive between the rotor of the switched reluctance motor and the impellers. Such a drive is characterized by the motor and the impeller rotating at the same speed. The drive shaft assembly may comprise one or more individual shafts linked by couplings so as to allow the drive to be transferred. A most convenient and advantageous assembly is one in which the rotor of the switched reluctance motor and the impeller are mounted on a single shaft.

A preferred embodiment of the present invention is a two stage centrifugal compressor assembly comprising:

a first compressor casing having a fluid inlet and a fluid outlet;

a first impeller rotatable within the first compressor casing;

a second compressor casing having a fluid inlet and a fluid outlet;

a second impeller rotatable within the second compressor casing; and a switched reluctance motor disposed between the first and second compressor casings and comprising a stator and a rotor rotatable within the stator;

a drive shaft; wherein the first impeller, second impeller and the rotor are mounted on the drive shaft and rotatable therewith; and the fluid outlet of the first compressor casing communicates with the fluid inlet of the second compressor casing.

BRIEF DESCRIPTION OF THE DRAWINGS

Embodiments of the present invention will now be described by way of example only having reference to the accompanying drawing, in which.

Figure 1:
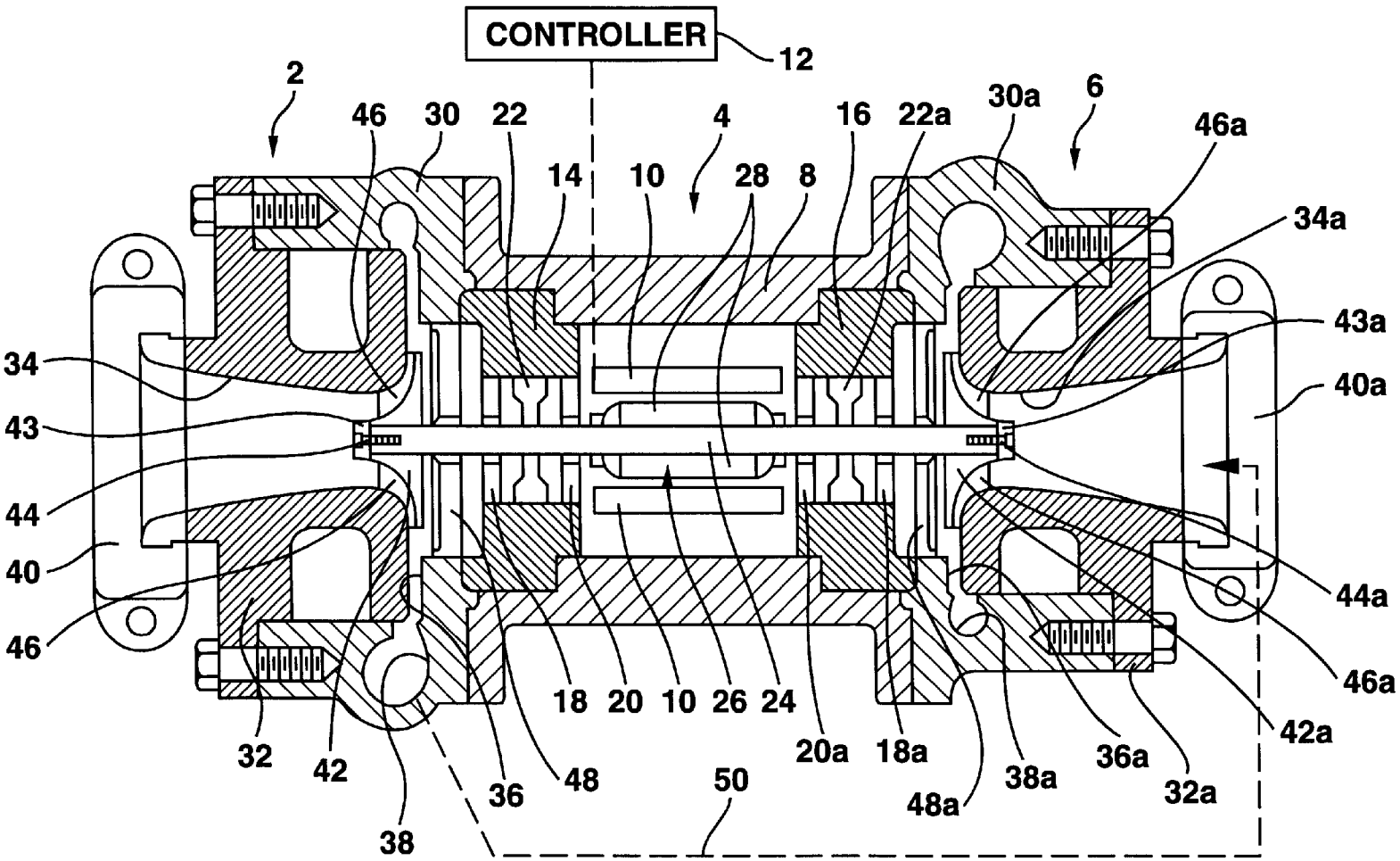
FIG. 1 is a diagrammatic illustration of a two-stage compressor assembly of a preferred embodiment of the present invention.

It is noted, however, that the appended drawing illustrates only a typical embodiment of the present invention and is therefore not to be considered a limitation of the scope of the invention which includes other equally effective embodiments.

DESCRIPTION OF THE PREFERRED EMBODIMENTS OF THE INVENTION

Referring to the Figure, a two-stage centrifugal compressor assembly is shown having a first centrifugal compressor stage generally represented as 2, a switched reluctance motor assembly generally represented as 4, and a second centrifugal compressor stage generally represented as 6.

Switched reluctance motors suitable for use in the present invention are known in the art. Examples of suitable motors are described in U.S. Pat. Nos. 5,770,910, 5,654,601 and 5,522,653. In general, a switched reluctance motor is a particular form of motor relying upon the principle of generating torque by the tendency of a moving rotor to take up a position within a stator in which the reluctance of the magnetic circuit is at a minimum. Typically, both the rotor and the stator has a magnetic salience, realized in the form of poles. Generally, the number of poles in the rotor will differ from the number of poles in the stator. A common arrangement has four poles in the rotor and six poles in the stator, although the present invention is in no way limited to the use of such an arrangement. Other possible arrangements of poles include from 4 to 32 poles in the stator and from 2 to 24 poles in the rotor, the number of poles in the rotor generally being less than in the stator. The poles of the stator are in the form of windings, connected to an electrical power source. The torque of the motor is controlled by a controller. The controller regulates the period during which a given stator winding is connected to the power source.

Referring to the Figure, the switched reluctance motor assembly 4 comprises a generally cylindrical motor casing 8. The motor casing may incorporate water cooling or other cooling means (not illustrated). Mounted to the casing are a plurality of poles in the form of windings making up the stator. Two pairs of poles are schematically represented as 10 in the Figure. From the foregoing discussion, it will be understood that the stator may comprise more than the two pairs of poles represented in the Figure. The poles 10 of the stator are connected to a controller, represented by box 12 in the Figure, and to an electrical power source (not shown). Controllers for the switched reluctance motor are known in the art. The controller 12 acts to open and close the electrical connection between the poles 10 and the power source. The controller may utilize a rotor position transducer (not shown) to determine the open and close timing of the electrical connections between the poles 10 and the power source. The rotor position transducer may comprise any suitable sensor, for example an optical or magnetic sensor. In the alternative, sensorless controllers may be employed.

The switched reluctance motor assembly further comprises first and second casing ends 14 and 16, mounted in the end portions of the generally cylindrical motor casing 8. Each casing end 14, 16 has a central bore extending co-axially with the central longitudinal axis of the motor casing 8. The first casing end 14 houses an outer seal 18 and an inner seal 20 at each end portion of the central bore. In addition, the first end casing 14 supports a bearing 22, mounted centrally within the central bore approximately equidistant from the outer and inner seals 18 and 20. Any suitable bearing may be employed that is capable of operating under the conditions of high speed of rotation required of the switched reluctance motor in the compressor assembly of the present invention. A preferred bearing configuration is a combined hydrodynamic/hydrostatic bearing as described in U.S. Pat. No. 4,365,849 and pending U.S. patent application no. 08/988,845, the contents of both documents being incorporated herein by reference. The second casing end 16 comprises a similar bore and supports outer and inner seals 18*a* and 20*a*, together with a bearing 22*a*, in a similar configuration to that in the first casing end 14.

A shaft 24 extends longitudinally through the motor casing 8 and is supported by the bearings 22 and 22*a* in the bores in the first and second casing ends 14 and 16. Thrust bearings may be provided in the casing ends 14 and 16 to accommodate thrust loads on the shaft. Suitable thrust bearings are conventional and well known in the art.

The shaft 24 has its longitudinal axis coincident with the longitudinal axis of the motor casing 8. A rotor 26 is mounted around the central portion of the shaft 24 and is positioned between the poles 10 of the switched reluctance motor. In this position, the rotor 26 is free to rotate within the magnetic fields generated by the poles 10 of the stator. The rotor 26 as shown in the Figure comprises a pair of poles 28. Other embodiments of the invention comprise rotors having multiple pairs of poles. Under the action of the controller 12, power is supplied to the poles 10 of the stator in such a way that the poles 28, and hence the rotor 26 and its attached shaft 24, are caused to move under the influence of a varying magnetic field.

The first compressor stage 2 is mounted on the end of the motor casing 8 adjacent the first casing end 14. The first compressor stage 2 comprises an outer compressor casing 30 and an inner compressor casing 32, both generally cylindrical in form and mounted with their central longitudinal axes coincident with that of the switched reluctance motor casing 8. The inner compressor casing 32 extends inwards from the outer free end of the outer compressor casing 30 and has a tapered central bore 34 narrowing in the direction of the switched reluctance motor assembly 4. The open end of the tapered central bore 34 in the free end of the compressor assembly 2 forms a fluid inlet for the first stage compressor.

The inner and outer compressor casings 30 and 32 define between their inner surfaces an annular chamber 36 extending radially outwards from the inner end of the tapered central bore 34. The tapered bore 34 and the annular chamber 36 together form a compression chamber. An annular cavity 38 extends around s and communicates with the annular chamber 36. The annular cavity 38 forms a fluid outlet for the first stage compressor. An inlet duct 40 is mounted on the outer end of the inner compressor casing 32 to provide a connection for the fluid inlet of the first stage compressor.

The shaft 24 extends beyond the first casing end 14 and into the compression chamber formed by the tapered bore 34 and the annular chamber 36. An impeller 42 is located in the compression chamber and is mounted on the end portion of the shaft 24 by means of an interference fit. A balance washer 43 is mounted on the end of the shaft 24 by a bolt 44. The impeller 42 has a plurality of vanes 46 having a curved tapered form such that a fluid flow chamber of reducing cross-sectional area normal to the flow is defined between the vanes 46 and the inner wall of the inner compressor casing 32 when travelling from the tip of the impeller to the base.

A compressor seal 48 is located in the inner orifice of the outer compressor casing 30 adjacent the first motor casing end and extends around the shaft 24.

In operation, fluid to be compressed, such as air and nitrogen gas, is drawn into the first stage compressor assembly 2 through the inlet duct 40, has velocity imparted mechanically by the vanes 46 of the impeller 42, and is caused to flow through the compression chamber. The compressed fluid leaves the first stage compressor through the annular cavity 38 in the outer casing 30.

A second stage compressor assembly 6 is mounted on the end of the motor casing 4 opposing the first stage compressor assembly 2. The second stage compressor assembly is comprised of components of similar form and function to those of the first stage compressor, indicated in the Figure by the same reference numerals as the corresponding components of the first stage compressor, but with the suffix "a".

The compressor assembly of the present invention may comprise a single compressor, or may comprise multiple compressors. Embodiments comprising multiple compressors may have the individual compressors linked so as to form multiple compressor stages. In the embodiment shown in the Figure, the two compressor assemblies 2 and 4 are linked to form a two-stage compressor. To effect this, the fluid outlet of the first compressor assembly 2, represented by the annular cavity 38, is connected to the inlet of the second compressor assembly 6 via the inlet duct 40*a*, as indicated by the connection 50.

The compressor assembly of the present invention provides a number of significant advantages over known compressor systems. In particular, the overall assembly, by dispensing with the need for a complicated coupling between the compressor and the motor, reduces the overall number of components. This in turn reduces unit costs and, most importantly, increases reliability. The compressor assembly of the present invention is particularly suited to high speed compressor systems, in particular those operating at speeds in excess of 25,000 rpm, more especially in excess of 50,000 rpm. In addition, the realization of the present invention makes available low powered compressor assemblies, that is ones in which the compressor has an input power of less than 200 horse power, that are both economical and reliable.

While the particular embodiment for the assembly of the present invention as herein disclosed in detail is fully capable of obtaining the objects and advantages herein stated, it is to be understood that it is merely illustrative of the presently preferred embodiments of the invention and that no limitations are intended by the details of construction or design herein shown other than as described in the appended claims.

What is claimed is:

1. A compressor assembly comprising:

a compressor having a compressor casing comprising a fluid inlet and a fluid outlet;

an impeller rotatable within the compressor casing;

a switched reluctance motor;

a rotatable drive shaft assembly extending from the switched reluctance motor into the compressor casing;

the impeller being mounted on the drive shaft assembly and rotatable therewith within the compressor casing; and the switched reluctance motor comprising a stator and a rotor, the rotor being mounted on the drive shaft assembly and rotatable therewith;

the compressor rotating in operation at a speed greater than 25,000 rpm.

2. A compressor assembly as claimed in claim 1, wherein the compressor is a centrifugal compressor.

3. A compressor assembly as claimed in claim 1, wherein the compressor rotates at a speed greater than 50,000 rpm.

4. A compressor assembly as claimed in claim 1, wherein the compressor has an input power of less than 200 horse power.

5. A compressor assembly as claimed in claim 1, comprising first and second compressors having first and second compressor casings;

each of the first and second compressor casings comprising a fluid inlet and a fluid outlet;

first and second impellers rotatable within the first and second compressor casings respectively;

the first and second impellers being mounted on the drive shaft assembly and rotatable therewith.

6. A compressor assembly as claimed in claim 5, wherein the fluid outlet of the first compressor casing communicates with the fluid inlet of the second compressor casing.

7. A compressor assembly as claimed in claim 5, wherein the switched reluctance motor is disposed between the first and second compressor casings, with the rotor of the switched reluctance motor being mounted on the drive shaft assembly between the first and second impellers.

8. A compressor assembly as claimed in claim 1, wherein the drive shaft assembly comprises a single drive shaft.

9. A two stage centrifugal compressor assembly comprising:

a first compressor casing having a fluid inlet and a fluid outlet;

a first impeller rotatable within the first compressor casing;

a second compressor casing having a fluid inlet and a fluid outlet;

a second impeller rotatable within the second compressor casing;

a switched reluctance motor disposed between the first and second compressor casings and comprising a stator and a rotor rotatable within the stator; and a drive shaft; wherein the first impeller, second impeller and the rotor are mounted on the drive shaft and rotatable therewith; and the fluid outlet of the first compressor casing communicates with the fluid inlet of the second compressor casing;

the first and second impellers rotating in operation at a speed greater than 25,000 rpm.

* * * * *